US005613279A

United States Patent [19]

Rhyne

[11] Patent Number: 5,613,279

[45] Date of Patent: Mar. 25, 1997

[54] APPARATUS FOR REMOVING CONTAMINANTS FROM RAW COTTON

[75] Inventor: Ralph H. Rhyne, Kings Mountain, N.C.

[73] Assignee: Kings Mountain Textile Machinery Company, Kings Mountain, N.C.

[21] Appl. No.: 602,927

[22] Filed: Feb. 16, 1996

[51] Int. Cl.[6] ..... D01G 9/08; D01G 9/20

[52] U.S. Cl. ..... 19/200; 19/48 R; 19/205

[58] Field of Search ..... 19/200, 205, 148, 19/24, 28, 34, 39, 40, 48 R

[56] References Cited

U.S. PATENT DOCUMENTS

| | | | |
|---|---|---|---|
| 3,388,434 | 6/1968 | Calhoun, Jr. | 19/203 |
| 4,040,948 | 8/1977 | Hergeth et al. | 19/200 X |
| 4,229,286 | 10/1980 | Bridges | 19/200 X |
| 4,479,286 | 10/1984 | Brown et al. . | |
| 4,512,060 | 4/1985 | Shofner . | |
| 4,519,114 | 5/1985 | Rhyne | 19/200 |
| 4,631,781 | 12/1986 | Shofner . | |
| 4,637,096 | 1/1987 | Wise et al. . | |
| 4,686,744 | 8/1987 | Shofner . | |
| 4,689,143 | 8/1987 | Miers . | |
| 4,736,493 | 4/1988 | Haass-Zöllick et al. | 19/200 |
| 4,797,976 | 1/1989 | Leifeld et al. | 19/200 |
| 4,934,029 | 6/1990 | Wilkes et al. | 19/39 X |

FOREIGN PATENT DOCUMENTS

| | | | |
|---|---|---|---|
| 3131174 | 2/1983 | Germany | 19/200 |
| 903389 | 2/1982 | U.S.S.R. | 19/200 |
| 1677101 | 9/1991 | U.S.S.R. | 19/200 |

*Primary Examiner*—John J. Calvert
*Attorney, Agent, or Firm*—Shefte, Pinckney & Sawyer

[57] ABSTRACT

An apparatus for removing contaminants from raw cotton traveling in an airstream includes a drum which is rotatably driven and mounted to a frame with the drum having a plurality of openings through, and further includes an assembly for directing the raw cotton against the drum, a first suction assembly for drawing contaminants from the cotton which is retained on the cotton collecting surface in a cotton impingement zone, a second suction arrangement for drawing cleaned raw cotton away from the cotton collection surface and including a cotton retention zone wherein the second suction airstream is opposed to the first suction airstream and a cotton release zone wherein the second suction airstream is assisted by atmospheric air in removing clean cotton from the cotton collection surface of the rotatable drum and delivering it to a clean cotton reservoir.

11 Claims, 4 Drawing Sheets

APPARATUS FOR REMOVING CONTAMINANTS FROM RAW COTTON

BACKGROUND OF THE INVENTION

The present invention relates broadly to machines and other apparatus for cleaning cotton and, more particularly, to an apparatus for cleaning raw cotton wherein a cotton laden airstream is caused to collide with a periorated rotating drum with vacuum cleaning action and vacuum discharge of clean cotton.

After cotton is picked and existing in its raw state of tufted balls, it typically includes a significant amount of foreign matter including dust, twigs, branches and other debris that has become entangled in the cotton along the way. Prior to using the cotton, the cotton should be cleaned to eliminate the twigs, dust and dirt and provide those working with the cotton with a clean cotton tuff.

Attempts have been made in the past to clean cotton by creating a cotton rich airstream and causing the impingement of the cotton onto a cleaning device. Examples include Shofner U.S. Pat. No. 4,686,744 which uses aeromechanical and electrodynamic release and separation forces applied to foreign particulate matter and fiber materials. Shofner has a series of patents including the aforementioned patent, and U.S. Pat. Nos. 4,512,060 and 4,631,781. Another device using an airstream is disclosed in Haass-Zöllick et al, U.S. Pat. No. 4,736,493, which uses a collection vessel with a separating surface arranged for allowing passage of the airstream and retaining at least one part of the fiber waste within the collection vessel. A similar attempt was made in Brown et al U.S. Pat. No. 4,479,286. Brown et al cause the impingement of cotton on a perforated rotating drum wherein the waste material is drawn through the drum and the cotton is rotated upwardly toward a vertically oriented clean cotton removal duct. All of the aforementioned patents are burdened with complexity, lack of complete cleaning or both.

SUMMARY OF THE INVENTION

It is accordingly an object of the present invention to provide an efficient apparatus for cleaning cotton wherein cotton is retained on a rotating drum for later withdrawal into a clean cotton airstream.

To that end, an apparatus for removing contaminants from raw cotton with the cotton traveling in an airstream includes a floor-standing frame with a rotatable drum mounted to the frame and having a cotton collection surface formed thereon at a radial spacing from an axis of rotation of the drum, the cotton collecting surface being formed with a plurality of openings therein with the openings being sized for the passage of contaminants therethrough while cotton tufts do not pass through the openings and remain on the cotton collecting surface. The present invention further includes an assembly for rotating the drum which is mounted to the frame and an assembly for directing raw cotton within the airstream against the drum with the directing assembly including a cotton delivery conduit mounted to the frame and having an outlet adjacent the cotton collecting surface to define a cotton impingement zone.

A first suction assembly is disposed at least partially within the drum for creating the airstream and drawing cotton in the airstream against the cotton collection surface, thereby drawing contaminants contained in the cotton through the openings in the drum with clean cotton remaining on the cotton collection surface, the first suction assembly including a contaminant receiving conduit having a contaminant inlet directed toward the drum and including a baffle with the baffle being disposed at a position vertically below the cotton impingement zone.

A second suction assembly is provided for moving cleaned raw cotton from the drum with the second suction arrangement including a cotton collection conduit disposed vertically below the cotton delivery conduit and including a cotton inlet directed toward the drum with an upper surface of the cotton collection inlet and the baffle defining a cotton retention zone therebetween with a lower surface of the cotton collection inlet and the baffle defining a cotton release zone. The drum is disposed for rotation sequentially through the cotton impingement zone, the cotton retention zone and the cotton release zone with a portion of the drum within the cotton release zone being open to atmosphere for causing the second suction assembly to draw atmospheric air through the drum to assist in removing cotton therefrom.

It is preferred that the delivery conduit have a widthwise dimension that is substantially greater than a vertical dimension thereof to provide a short and wide cotton delivery conduit. It is further preferred that the cotton collection conduit extend in a generally horizontal manner away from the drum and curve downwardly and reversibly through 180° to extend to a cotton collection receiver.

Preferably, the drum is formed as a hollow cylinder, open at both ends, and having the contaminant receiving conduit disposed therein to extend outwardly from the drum to a contaminant receiving container. It is further preferred that the contaminant receiving conduit include a suction manifold intermediate the contaminant receiving conduit and the contaminant inlet with the contaminant inlet projecting outwardly therefrom to a position closely adjacent the drum. The drum is preferably mounted to the frame using at least four wheels with each of the wheels mounted to the frame for free rotation with respect thereto and the drum resting on each of the wheels. The drive assembly preferably includes a motor having a pinion attached thereto for rotated movement caused thereby and an endless belt trained around the drum and the pinion for rotated movement of the drum responsive to actions of the motor. The present invention preferably further includes a plurality of stabilizer wheels mounted to the frame for contact with end portions of the drum to prevent the drum from experiencing side-to-side movement.

By the above, the present invention provides a simple and effective apparatus for cleaning dirt, dust, twigs and other contaminants from raw cotton traveling in an airstream.

DETAILED DESCRIPTION OF THE PREFERRED EMBODIMENT

Figure 1:
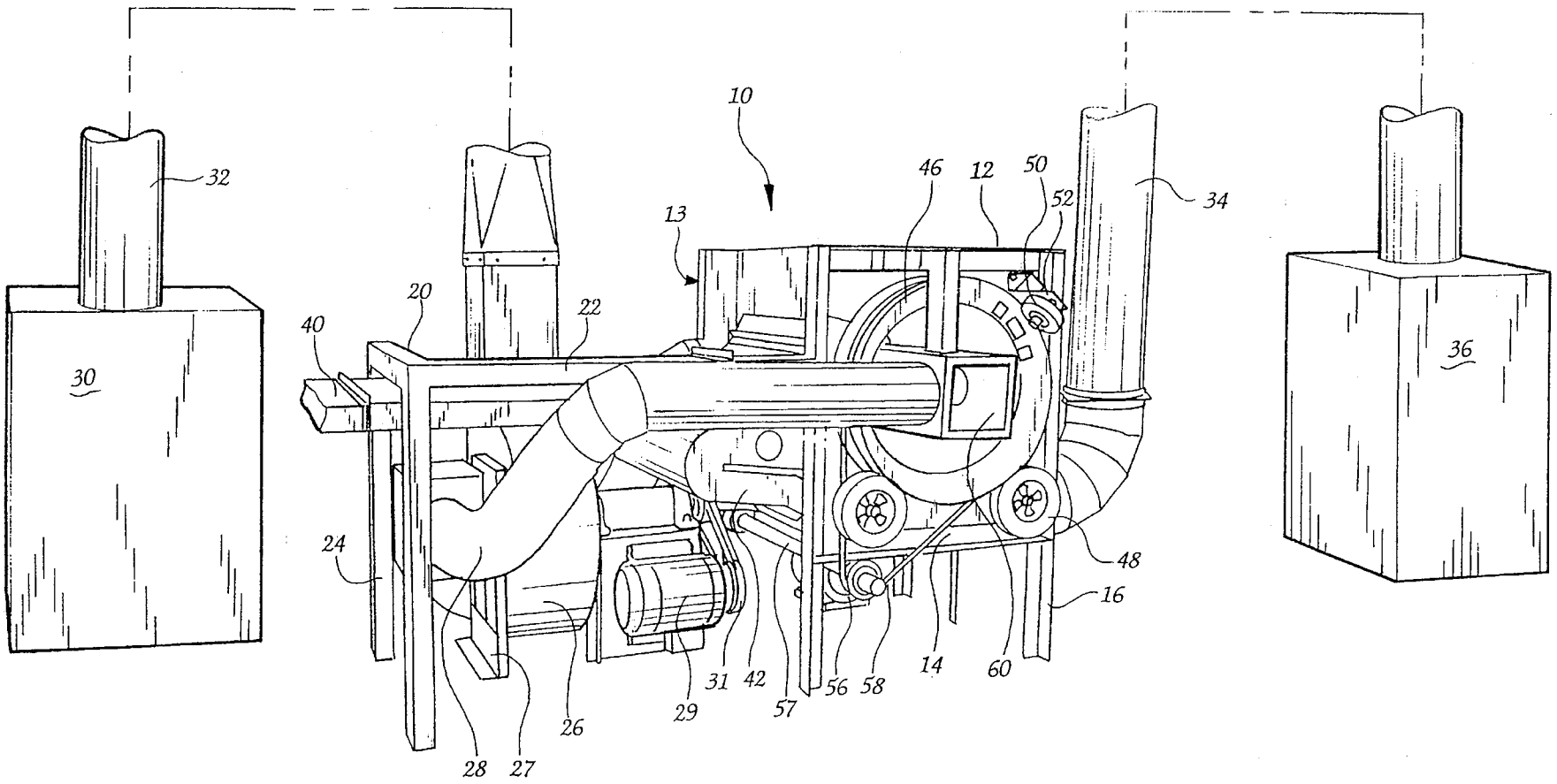
FIG. 1 is a perspective view of a raw cotton cleaning apparatus according to the preferred embodiment of the present invention.

Turning now to the drawings and more particularly to FIG. 1, an apparatus for cleaning raw cotton is illustrated generally at 10 and is formed in and around the basic structure of an upstanding frame 12. The frame 12 is typically made of steel channel material and includes a series of interconnected horizontally oriented cross members 14 and vertically oriented members 16, with the vertically oriented members 16 serving as legs. The frame 12 includes a primary frame 13 which is formed as a generally skeletal box. An extended frame 20 projects therefrom and includes a horizontally oriented cross member 22 extending from one end of the primary frame 13 and, along with floor-standing vertically oriented support members 24, forms a generally rectangular, skeletal extended frame 20.

Figure 2:
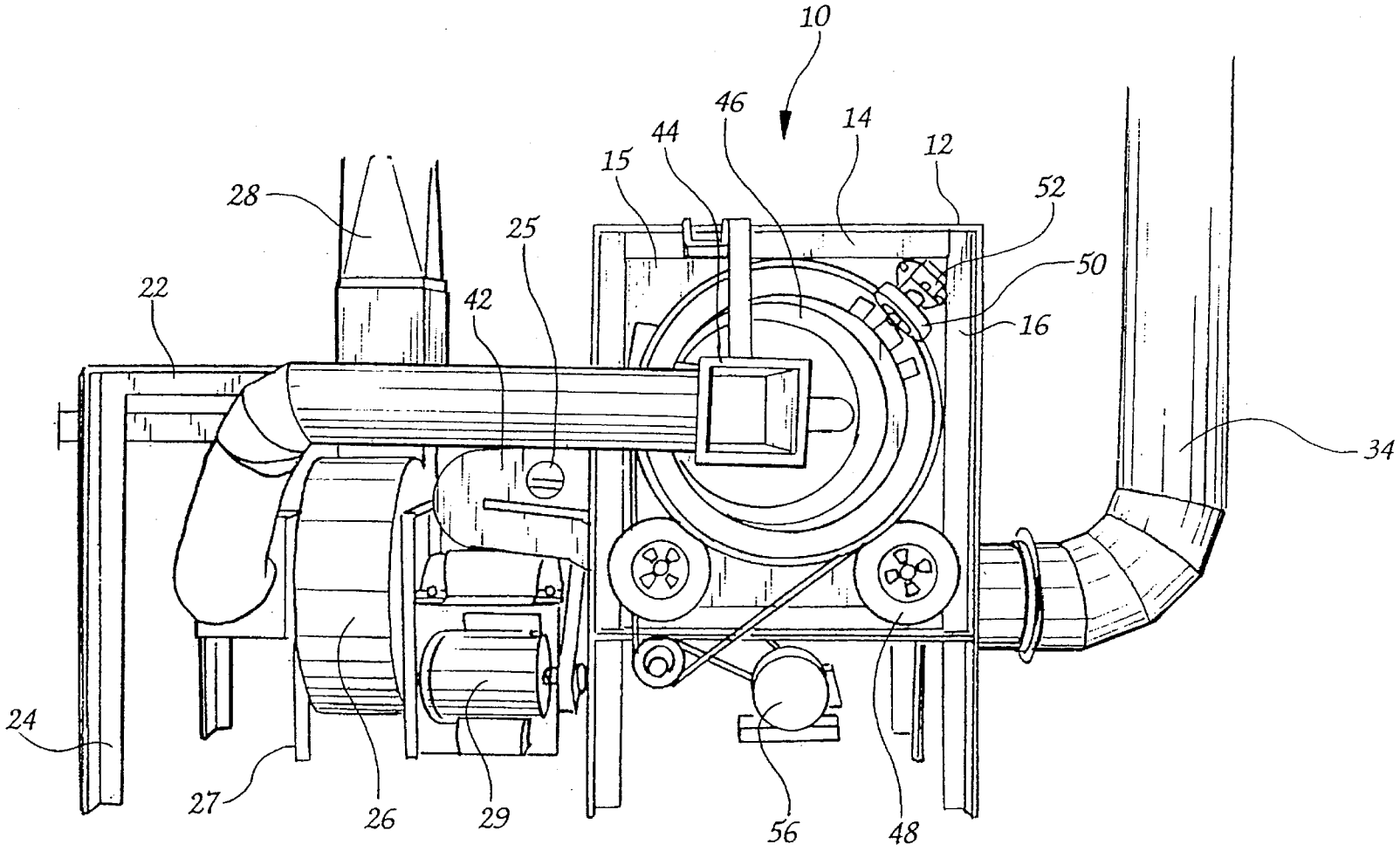
FIG. 2 is a side view of the cotton cleaning apparatus illustrated in FIG. 1.
Figure 4:
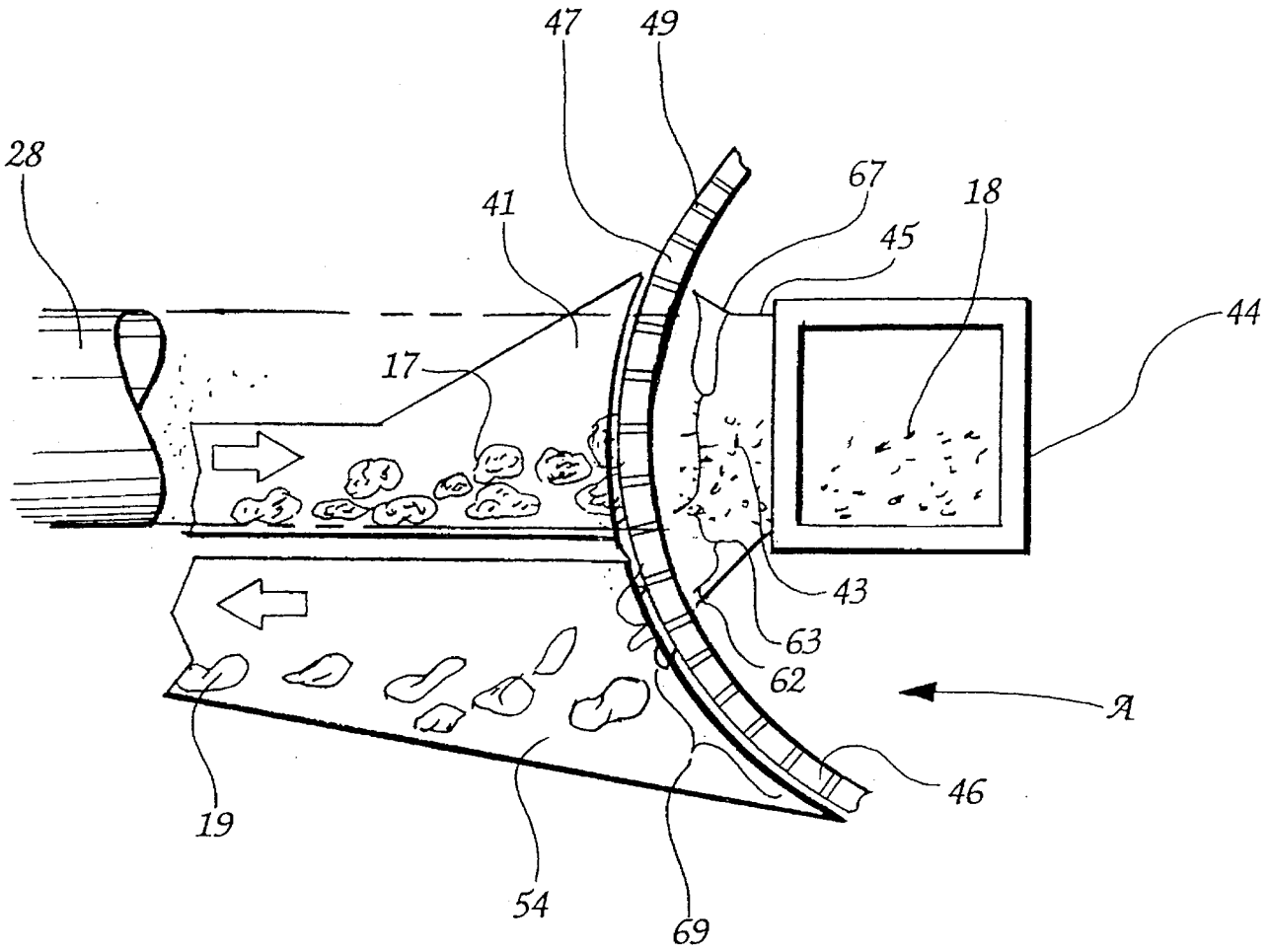
FIG. 4 is detail diagrammatic view of the cotton action zones of the present invention.

The primary frame 13 houses a rotatable drum 46 which is supported by a pair of wheels 48 disposed at approximately four o'clock and eight o'clock position as seen in FIG. 2. The support wheels 48 are rotatably mounted to the primary frame 13 and formed of rubber so that they will cushion the drum and rotate therewith as the drum is separately driven. The drum is supported in a lateral direction by horizontal stabilizer wheels 50 which are formed of rubber and mounted to the frame 12 using a bracket 52 at an orientation wherein the axis of rotation of the stabilizer wheels 50 is orthogonal to the axis of rotation of the drum 46. Although the stabilizer wheels 50 and the support wheels 48 are shown on one side of the frame 12 in FIGS. 1 and 2, it should be understood that a similar support structure is provided on the opposite side of the frame. The drum is driven by a motor 56 attached to an endless drive belt 58, through a frame-mounted journaled shaft 57, the belt 58 being trained around the drum so that the drum will rotate responsive to the rotation of the motor armature. As seen in FIG. 4, the drum 46 is formed with a cotton collection surface 47 spaced a radial distance away from the axis of rotation of the drum and having a series of perforations 49 formed through the drum. The perforations 49 are sufficiently large so that trash and other debris will pass therethrough while there simultaneously sufficiently small that cotton tufts cannot pass therethrough.

Cotton, in the raw form of tufts and balls, is caused to circulate through the apparatus by two separate suction assemblies. The first suction assembly generates a cotton delivery airstream, causes trash and debris removal from the cotton, and removes the trash and debris from the apparatus. The second suction assembly generates an airstream for removing cleaned cotton from the apparatus.

With regard to the first suction assembly, raw, uncleaned cotton 19 is supplied from a source (not shown) for cleaning and is delivered to the apparatus through a cotton inlet conduit 40. The cotton inlet conduit 40 is formed with a generally rectangular cross section having a widthwise dimension which is substantially greater than a vertical dimension thereof to provide a short and wide delivery conduit for enhanced velocity of cotton delivery. The cotton inlet conduit 40 is mounted to the extended frame 20 and directed toward the drum 46, and includes a flared outlet 41 directed to the drum 46. The airstream is created within the first suction assembly by a fan 26 which is driven by a motor 29 through an endless belt 31. The fan 26 is mounted adjacent the extended frame 20 on its own frame 27 which mounts the fan to the floor. The first suction assembly and its fan 26 provides the airstream for delivery of cotton and trash withdrawal. A trash withdrawal manifold 44 is mounted to the frame 12 and is formed as a generally rectangular elongate box disposed within the drum 46, parallel to the axis of rotation of the drum 46. A trash removal outlet 45 is formed as a flared opening from the manifold 44 with panels forming the contaminant inlet 43 extending from the manifold 44 in a flared manner to the drum 46. A lower surface of the contaminant inlet 45 is formed as a baffle 62. Since the drum 46 is open to atmosphere, atmospheric air exists in an area surrounding the manifold 44. The contaminant inlet 45 is aligned with the output of the cotton delivery outlet 41 with the rotatable drum 46 disposed therebetween. As seen in FIG. 4, and as is a key feature of the present invention, and as will be explained in greater detail hereinafter, the upper surface of the contaminant inlet 45 is aligned with an upper surface of the cotton delivery outlet 41 while the baffle 62 is disposed a predetermined distance below the lower surface of the cotton delivery outlet 41. The region between the upper surface of the cotton delivery outlet 41 which is aligned across the drum 46 with the upper surface of the contaminant inlet 45 and the lower surface of the cotton delivery outlet 41 defines a cotton impingement zone 67 while the region between the lower surface of the cotton delivery outlet 41 and baffle 62 defines a cotton retention zone 63, as seen in FIG. 4.

AS previously stated, the second suction assembly is provided for the removal of clean cotton from the cotton collection surface and delivering the cotton to a clean cotton reservoir 36 disposed a predetermined distance away from the apparatus 10 and connected therethrough using conventional piping 34. This relationship is illustrated generally in FIG. 1. The second suction assembly creates a second airstream containing only clean cotton therein. The cotton is drawn away from the drum 46 through a cotton removal conduit 43 having a contoured cotton collection inlet 54 which if formed with a curvature similar to the curvature of the drum to provide a closely adjacent relationship between the drum 46 and the cotton collection inlet 54. The cotton collection inlet 54 tapers into a cotton collection conduit 43, which is formed as a generally rectangular conduit, in generally parallel alignment with the cotton delivery conduit 40 for a predetermined distance away from the drum 46. There, the cotton collection conduit 43 is caused to make a 180° turn and thereafter travel under the drum 46 and away from the apparatus 10. The 180° turn of the cotton removal conduit 42 allows the parallel positioning of the cotton delivery conduit 40 and the cotton removal conduit 42. This relationship is best seen in FIG. 3.

Figure 3:
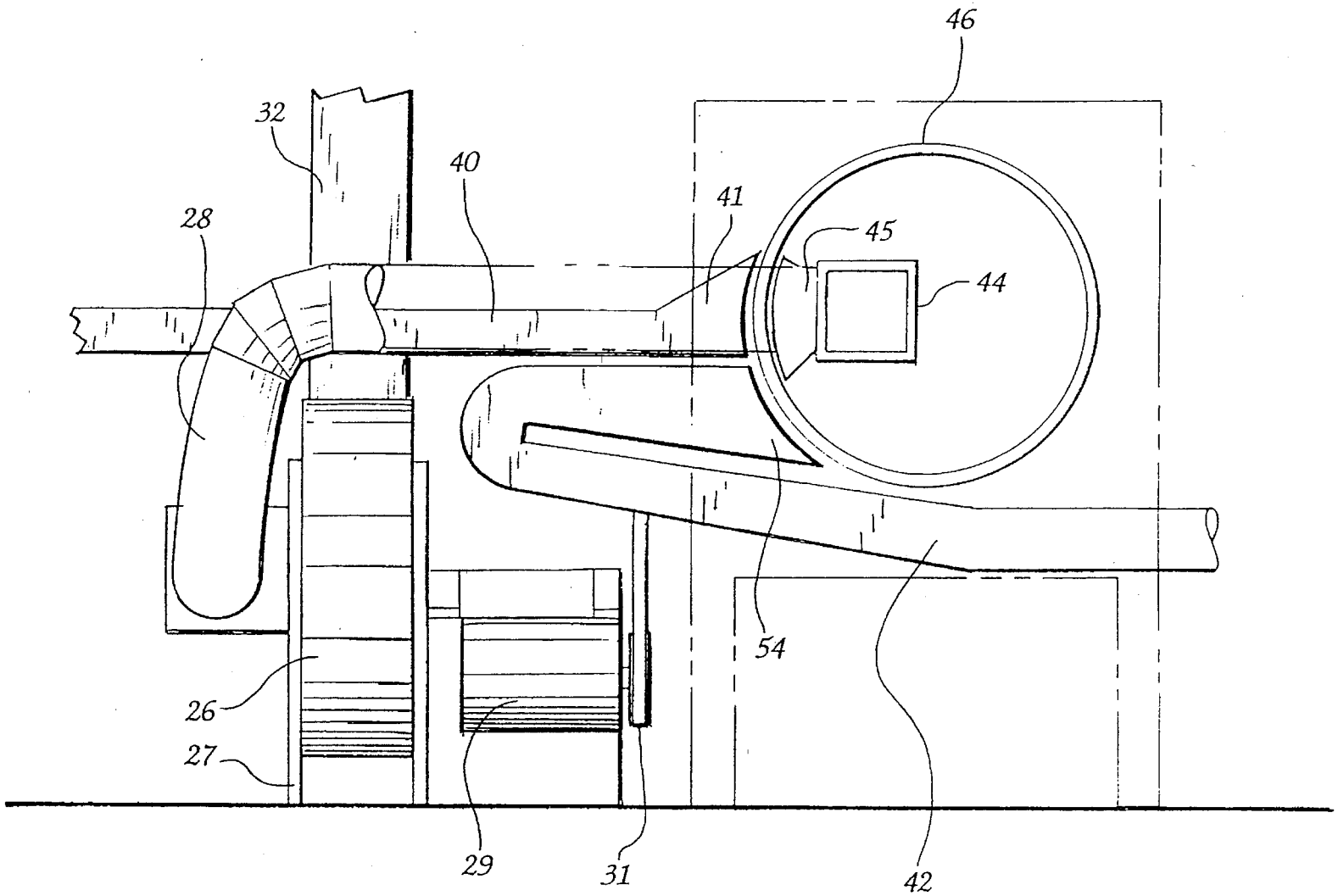
FIG. 3 is a side cutaway view of the cotton cleaning apparatus illustrated in FIG. 1.

In operation, raw cotton 17 containing trash and other contaminants is drawn from the supply (not shown) through the cotton inlet conduit 40 as best seen in FIGS. 3 and 4. The dirty cotton 17 is drawn to the cotton cleaning surface 47 by the airstream created through the cotton delivery conduit 40, the manifold 44, and the contaminant conduit 28 by the fan 26. All the while, any given position on the drum 46 is being rotated through the cotton impingement zone 67, the cotton retention zone 62 and the cotton release zone 69. The clean cotton 19 is retained on the cotton cleaning surface 47 while the trash 18 is drawn through the perforations 49 into the manifold 44 and is delivered through the aforesaid conduit system to the contaminant reservoir 30 for later removal. Due to rotation of the drum 46, the clean cotton 19 is rotated away from the cotton impingement zone 67 to create room for more contaminated cotton 17. The clean cotton 19 then travels through the cotton retention zone 62 where it remains held in place by the first suction assembly's airstream. Since the first suction assembly's airstream is somewhat stronger than the second suction assembly airstream, the cotton is retained on the cotton collection surface 47 against the flow of the second suction airstream until the cotton reaches the cotton release zone 69. There, the airstream created by the second suction assembly draws atmospheric air A through the perforations 49 and the clean cotton 19 is rapidly removed from the rotating cotton collection surface 47 for delivery through the cotton removal conduit 42 to a clean cotton collection reservoir 36. The contoured inlets and outlets, and their positioning relative to one another, create three distinct pressure zones within the cleaning apparatus 10 for efficient, effective and rapid cotton cleaning.

By the above, the present invention provides an apparatus for cleaning raw cotton which offers a rapid method to clean a large quantity of cotton traveling in an airstream.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for removing contaminants from raw cotton, said raw cotton traveling in an airstream, comprising:

a floorstanding frame;

a rotatable drum mounted to said frame and having a cotton collection surface formed thereon at a radial spacing from an axis of rotation of said drum, said cotton collecting surface being formed with a plurality of openings therein, said openings being sized for the passage of contaminants therethrough while cotton tuffs do not pass through said openings and remain on said cotton collecting surface;

means for rotatably driving said drum mounted to said frame;

means for directing raw cotton within the airstream against said drum, said directing means including a cotton delivery conduit mounted to said frame and having an outlet adjacent said cotton collecting surface defining a cotton impingement zone;

first suction means disposed at least partially within said drum for creating the airstream and drawing said cotton in the airstream against said cotton collecting surface, thereby drawing contaminants contained in the cotton through said openings in said drum, with cleaned cotton remaining on said cotton collection surface, said first suction means including a contaminant receiving conduit having a contaminant inlet directed toward said drum and including a baffle, said baffle being disposed at a position vertically below said cotton impingement zone;

second suction means for removing cleaned raw cotton from said drum, said second suction means including a cotton collection conduit disposed vertically below said cotton delivery conduit and including a cotton collection inlet directed toward said drum with an upper surface of said cotton collection inlet and said baffle defining a cotton retention zone therebetween, with a lower surface of said cotton collection inlet and said baffle defining a cotton release zone, said drum being disposed for rotation sequentially through said cotton impingement zone, said cotton retention zone and said cotton release zone, with a portion of said drum within said cotton release zone being open to atmosphere for causing said second suction means to draw atmospheric air through said drum to assist in removing cotton therefrom.

2. An apparatus for removing contaminants from raw cotton according to claim 1 wherein said delivery conduit has a widthwise dimension that is substantially greater than a vertical dimension thereof to provide a short and wide cotton delivery conduit.

3. An apparatus for removing contaminants from raw cotton according to claim 1 wherein said cotton collection conduit extends in a generally horizontal manner away from said drum and curves downwardly and reversedly through 180° to extend to a cotton collection receiver.

4. An apparatus for removing contaminants from raw cotton according to claim 1 wherein said drum is formed as a hollow cylinder, open at both ends, and having said contaminant receiving conduit disposed therein to extend outwardly from said drum to a contaminant receiving container.

5. An apparatus for removing contaminants from raw cotton according to claim 4 wherein said contaminant receiving conduit includes a suction manifold intermediate said contaminant receiving conduit and said contaminant inlet with said contaminant inlet projecting outwardly therefrom to a position closely adjacent said drum.

6. An apparatus for removing contaminants from raw cotton according to claim 1 wherein said drum is mounted to said frame using at least four wheels, with each said wheel mounted to said frame for free rotation with respect thereto and said drum resting on each said wheel.

7. An apparatus for removing contaminants from raw cotton according to claim 6 wherein said drive means includes a motor having a pinion attached thereto for rotative movement caused thereby, and an endless belt trained around said drum and said pinion for rotative movement of said drum responsive to actions of said motor.

8. An apparatus for removing contaminants from raw cotton according to claim 6 and further comprising a plurality of stabilizer wheels mounted to said frame for contact with end portions of said drum to prevent said drum from experiencing side to side movement.

9. An apparatus for removing contaminants from raw cotton, said raw cotton traveling in an airstream, comprising:

a floorstanding frame;

a rotatable drum mounted to said frame and having a cotton collection surface formed thereon at a radial spacing from an axis of rotation of said drum, said cotton collecting surface being formed with a plurality of openings therein, said openings being sized for the passage of contaminants therethrough while cotton tufts do not pass through said openings and remain on said cotton collecting surface, said drum being mounted to said frame using at least four wheels, with each said wheel mounted to said frame for free rotation with respect thereto and said drum resting on each said wheel;

means for rotatably driving said drum mounted to said frame including a motor having a pinion attached thereto for rotative movement caused thereby, and an endless belt trained around said drum and said pinion for rotative movement of said drum responsive to actions of said motor;

a plurality of stabilizer wheels mounted to said frame for contact with end portions of said drum to prevent said drum from experiencing side to side movement;

means for directing raw cotton within the airstream against said drum, said directing means including a cotton delivery conduit mounted to said frame and having a widthwise dimension that is substantially greater than a vertical dimension thereof to provide a short and wide cotton delivery conduit with an outlet adjacent said cotton collecting surface defining a cotton impingement zone;

first suction means disposed at least partially within said drum for creating the airstream and drawing said cotton in the airstream against said cotton collecting surface, thereby drawing contaminants contained in the cotton through said openings in said drum, with cleaned cotton remaining on said cotton collection surface, said first suction means including a contaminant receiving conduit having a contaminant inlet directed toward said drum and including a baffle, said baffle being disposed at a position vertically below said cotton impingement zone;

second suction means for removing cleaned raw cotton from said drum, said second suction means including a cotton collection conduit extending in a generally horizontal manner away from said drum and curving downwardly and reversedly through 180° to extend to a cotton collection receiver, said cotton collection conduit being disposed vertically below said cotton delivery conduit and including a cotton collection inlet directed toward said drum with an upper surface of said cotton collection inlet and said baffle defining a cotton retention zone therebetween, with a lower surface of said cotton collection inlet and said baffle defining a cotton release zone, said drum being disposed for rotation sequentially through said cotton impingement zone, said cotton retention zone and said cotton release zone, with a portion of said drum within said cotton release zone being open to atmosphere for causing said second suction means to draw atmospheric air through said drum to assist in removing cotton therefrom.

10. An apparatus for removing contaminants from raw cotton according to claim 9 wherein said drum is formed as a hollow cylinder, open at both ends, and having said contaminant receiving conduit disposed therein to extend outwardly from said drum to a contaminant receiving container.

11. An apparatus for removing contaminants from raw cotton according to claim 10 wherein said contaminant receiving conduit includes a suction manifold intermediate said contaminant receiving conduit and said contaminant inlet with said contaminant inlet projecting outwardly therefrom to a position closely adjacent said drum.

* * * * *

UNITED STATES PATENT AND TRADEMARK OFFICE

CERTIFICATE OF CORRECTION

PATENT NO. : 5,613,279

DATED : March 25, 1997

INVENTOR(S) : Ralph H. Rhyne

It is certified that error appears in the above-identified patent and that said Letters Patent is hereby corrected as shown below:

Column 1, line 9, delete "periorated" and insert --perforated--.

Column 1, line 18, delete "tuff." and insert --tuft.--.

Column 2, line 60, after "is" insert --a--.

Column 3, line 37, delete "there" and insert --they are--.

Column 3, line 61, delete "provides" and insert --provide--.

Column 4, line 20, delete "AS" and insert --As--.

Column 4, line 30, delete "if" and insert --is--.

Column 4, line 62, delete "assembly" and insert --assembly's--.

Column 5, line 40, delete "tuffs" and insert --tufts--.

Abstract, line 4, delete "through" and insert --therethrough--.

Signed and Sealed this

Fifteenth Day of September, 1998

*Attest:*

Bruce Lehman

BRUCE LEHMAN

*Attesting Officer*

*Commissioner of Patents and Trademarks*